US006142441A

United States Patent [19]

Vannucci

[11] Patent Number: 6,142,441

[45] Date of Patent: Nov. 7, 2000

[54] COMMERCIAL LOCATION CHRISTMAS TREE STAND

[76] Inventor: E. Daniel Vannucci, 1510 Camino Way, Woodland, Calif. 95695

[21] Appl. No.: 09/162,894

[22] Filed: Sep. 29, 1998

[51] Int. Cl.[7] ..... F16M 13/00

[52] U.S. Cl. ..... 248/519; 47/40.5; 248/523

[58] Field of Search ..... 248/519, 511, 248/523, 524, 525, 527, 529, 346.01, 346.03, 127, 146, 151, 188.7, 163.1, 432, 159, 125.8, 121, 518; 47/40.5

[56] References Cited

U.S. PATENT DOCUMENTS

| | | | |
|---|---|---|---|
| 2,205,271 | 6/1940 | Pleiss | 248/529 |
| 2,854,203 | 9/1958 | Grube | 47/40.5 |
| 2,905,414 | 9/1959 | Zierden | 47/40.5 |
| 3,469,342 | 9/1969 | Morris | 47/40.5 |
| 4,006,560 | 2/1977 | Schulz | 47/40.5 |
| 4,007,901 | 2/1977 | Mancini et al. | 248/526 |
| 4,496,129 | 1/1985 | Waterman et al. | 248/527 |
| 4,967,508 | 11/1990 | Reynolds | 47/40.5 |
| 5,014,461 | 5/1991 | Vom Braucke et al. | 47/40.5 |
| 5,465,529 | 11/1995 | Park | 47/40.5 |

*Primary Examiner*—Anita M. King
*Attorney, Agent, or Firm*—Mark C. Jacobs, Esq.

[57] ABSTRACT

A Christmas tree stand intended for the support of large Christmas trees at commercial locations, which stand has a main body portion which has a trio of upstanding spaced tubular members, and three leg portions, each having three parts, one part of each leg being disposable within one of the respective upstanding tubular members. Each leg portion also includes a tree engaging member, the trio of which in combination with a main body pin onto which the tree trunk has been previously impaled, can support the tree in a generally vertical position.

11 Claims, 3 Drawing Sheets

COMMERCIAL LOCATION CHRISTMAS TREE STAND

This invention relates to a stand for the support of an evergreen tree which is used at Christmas time as a Christmas tree.

FIELD OF THE INVENTION

This invention pertains to supports or stands for Christmas trees.

BACKGROUND OF THE INVENTION

It is well known that at commercial locations, extra precautions must be taken to assure the public that a supported Christmas tree is safe and won't topple. Therefore most tree riggers have utilized elaborate wire and turnbuckle schemes to fully balance large trees of up to 20 feet tall. While safe at the beginning, the rigging is often difficult to see and can itself create a hazard for the unwary. In addition, if one of the guy wires is accidentally hit, or moved the supported tree can become unstable and unbalanced and perhaps fall. Indeed such riggings create negative eye appeal.

Therefore a need for an unencumbered support that does away with rigging and which need not be attached to the floor or walls of the building is indeed needed.

An object therefore of this invention is to provide a novel Christmas tree stand which is capable of supporting trees having a trunk diameter of up to about 12 inches.

Another object is to provide a Christmas tree stand which requires no riggings or guy wires.

A third object is to provide a Christmas tree stand which is easy to set up by one or two persons.

A further object is to provide a Christmas tree stand which can be used year after year and which is easy to store.

A yet further object is to provide a Christmas tree stand which requires no tools for assembly or disassembly.

Other objects of the invention will in part be obvious and will in part appear hereinafter.

The invention accordingly comprises the device possessing the features properties and the relation of components which are exemplified in the following detailed disclosure and the scope of the application of which will be indicated in the appended claims.

For a fuller understanding of the nature and objects of the invention reference should be made to the following detailed description, taken in conjunction with the accompanying drawings.

While no actual patent search has been carried out, applicant who has been in the Christmas tree business for over 20 years and is unaware of any stand that either resembles the one of this invention or operates in the manner that this one does.

SUMMARY OF THE INVENTION

A Christmas tree stand intended for the support of large Christmas trees at commercial locations is disclosed. The stand has a main body portion which has a trio of upstanding spaced tubular members, and three leg portions, one of which is disposable within each of the upstanding tubular members. Each leg portion includes a tree engaging member, the trio of which in combination with a main body pin onto which the tree trunk has been previously impaled, support the tree in a generally vertical position.

DESCRIPTION OF THE PREFERRED EMBODIMENT

Figure 1:
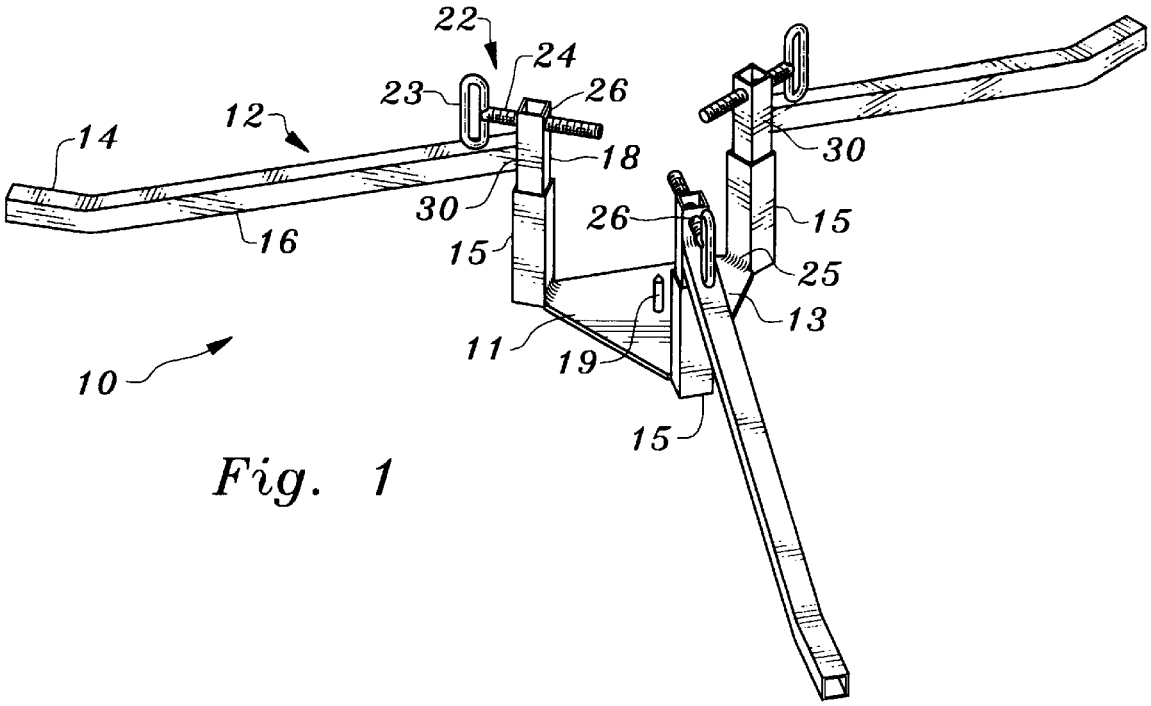
FIG. 1 is a side perspective view of the Christmas tree stand of this invention.
Figure 2:
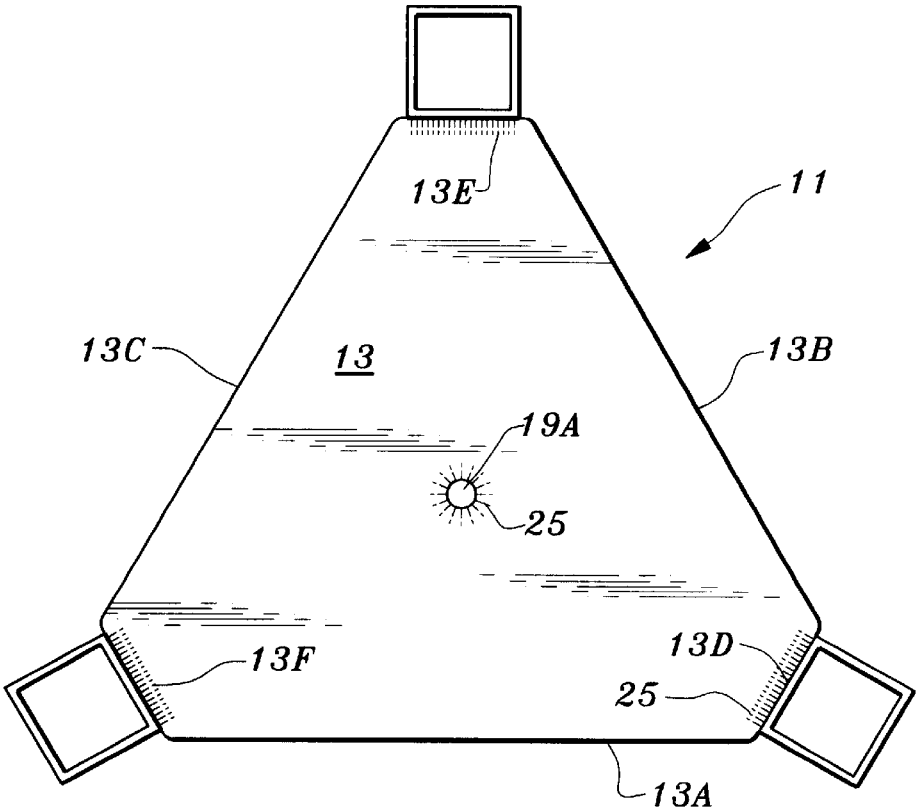
FIG. 2 is a bottom plan view of one component thereof.

In FIG. 1, the Christmas tree stand of this invention is seen. Stand 10, includes a main body 11 and a leg portion 12. The main body is best seen in FIG. 2. Here the main body 11 is seen in an inverted position. The body 11 is generally triangular and has three equilateral sides 13A, 13B, and 13C, and 3 chamfered corners 13D, 13E, and F. A pin 19 whose head is seen here is disposed through an aperture, 19A and welded into position along weld line 25. A 1.25-inch diameter (OD) tube, preferably a square tube is welded or otherwise attached preferably along one bottom edge thereof to each of the chamfered corners 13D, 13E, and F. Designator 25 refers to the weld of each inverted upstanding tube to its respective corner of the main body 13.

Figure 4:
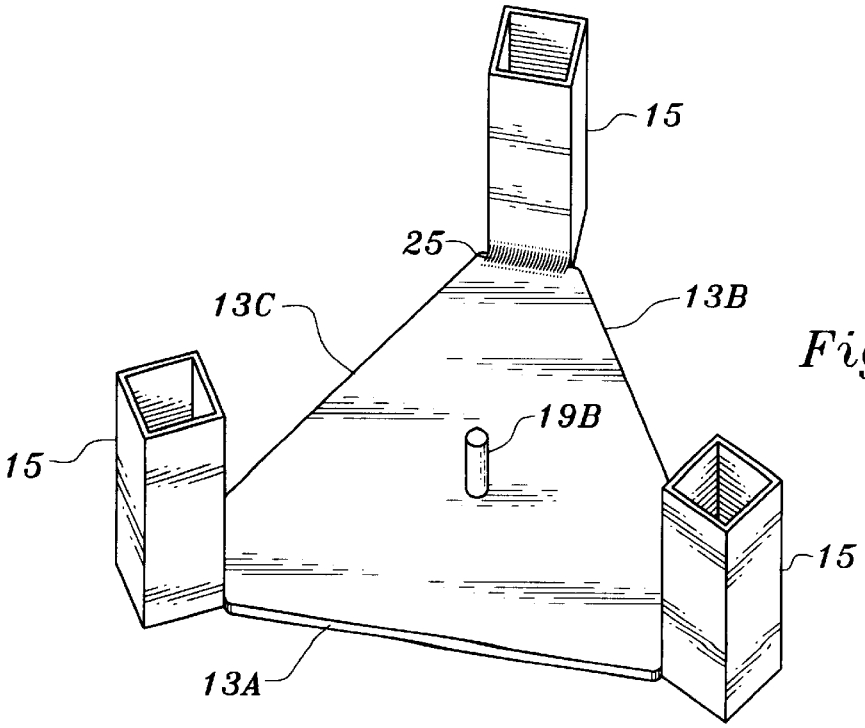
FIG. 4 is a top perspective view showing the tree trunk engaging mechanism of one leg of this invention.

Reference now to FIG. 4 shows the aforementioned tubes 15 in an upright or upstanding position. The shaft 19B of the pin 19 is also seen. A second weld 25 at the tube—base interface also strengthens the attachment of the upstanding tubes to the base 13 on the obverse side of the base.

Figure 3:
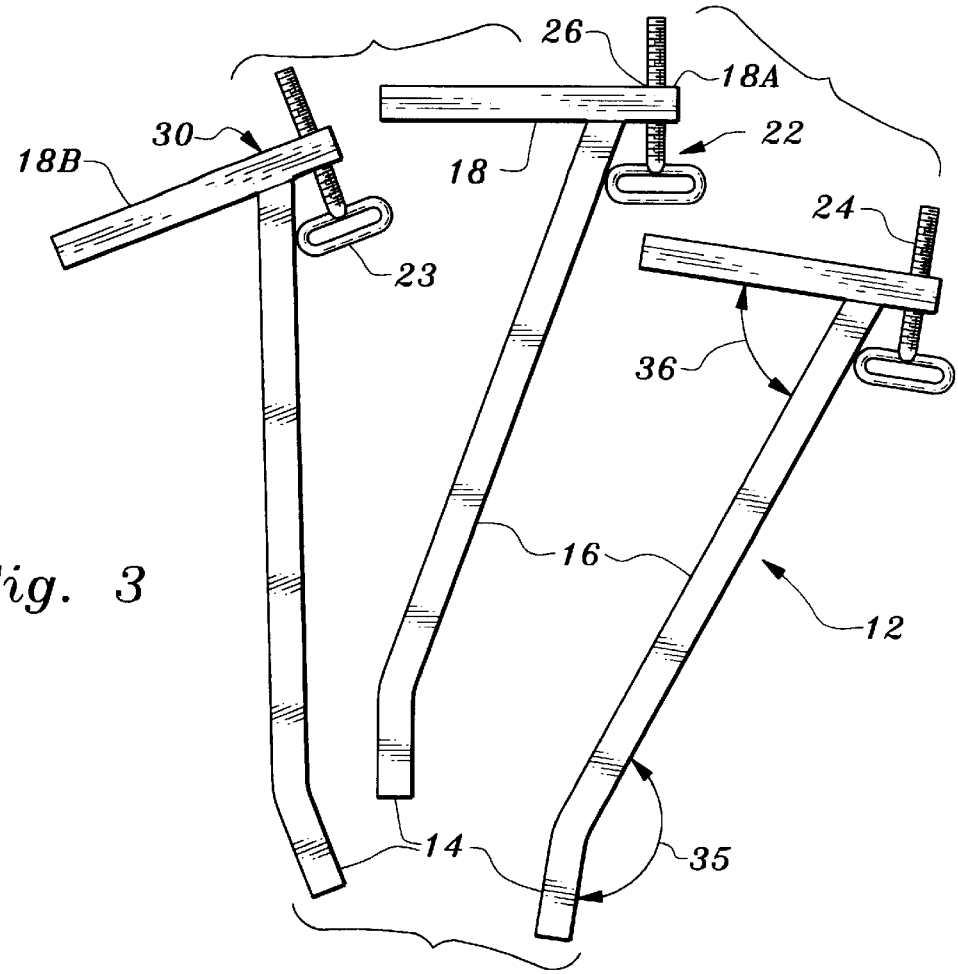
FIG. 3 is a top plan view of the legs of this invention disassembled.

In FIG. 3 the three leg portions 12 are seen, each is a duplicate of the other. Each leg portion consists of three sections. The first section is a relatively short section 14 which is angularly connected to a second longer section 16 at the proximal end thereof, at about a 160 degree angle, —designator 35—in an upwardly direction. (See also FIG. 1.) The third leg section 18, has a shorter part 18A, and a longer part 18B. These parts are continuous and are measured from the point of attachment to the leg portion's second section. Thus 18A, as seen in FIG. 3, is disposed to the right of the second section, 16, and when in position is above the second section, 16, as per FIG. 6.

The third section 18, is connected at a point spaced down slightly, about 20–25 percent of the total length thereof, (the imaginary demarcation point between part 18A and part 18B and designated as point 30) along the length thereof to the second section, 16 and is disposed at a 70 degree angle downwardly—designator 36—to the distal end of the second section, 16.

The third section, 18 is of an intermediate length relative to the other two sections.

As seen in FIGS. 1 and 3, leg portions 12 are constructed of square tubing, to match the configuration of the upstanding tubular members of the main body. Since each part 18B of each leg section nests into a respective upstanding tubular member, the outside diameter of these 18B parts should be about 0.25 inches smaller to ensure a tight yet removable fit of each 18B into its respective upstanding tube 15.

Figure 5:
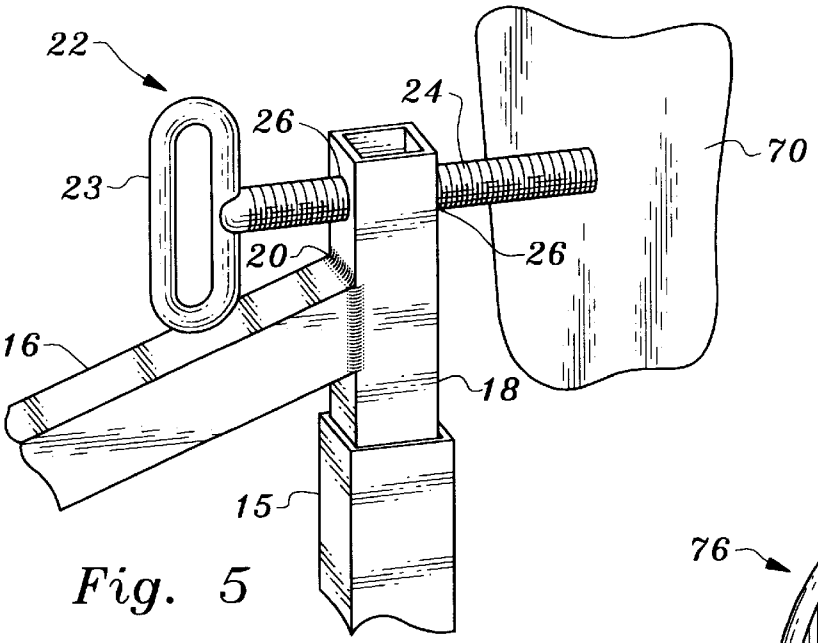
FIG. 5 is a close-up perspective view showing the tree trunk engaging mechanism of on leg of this invention.

Whereas the first section 14, and the second section, 16 of the leg portion 12 can be fabricated by bending a single tube into the two parts, the third section 18 is formed from a separate tube which is welded into position at weld 20 seen in FIG. 5.

As noted earlier, section 18 has two parts, 18A and 18B. The part 18A includes an aligned pair of self-tapping bores 26 for the receipt of a thumb screw, 22 in each of said pairs of bores. See FIG. 5, wherein the thumb screw 22 with its two segments; namely, the handle segment 23 connected to the threaded shaft 24 is seen disposed in the spaced aligned bore pair 26. The use of thumb screws for applying pressure is well known in the hardware field, and such parts are readily available from various vendors. The thumb screw shaft 24 is seen to be pressing upon the Christmas tree trunk 70 in FIG. 5.

Figure 6:
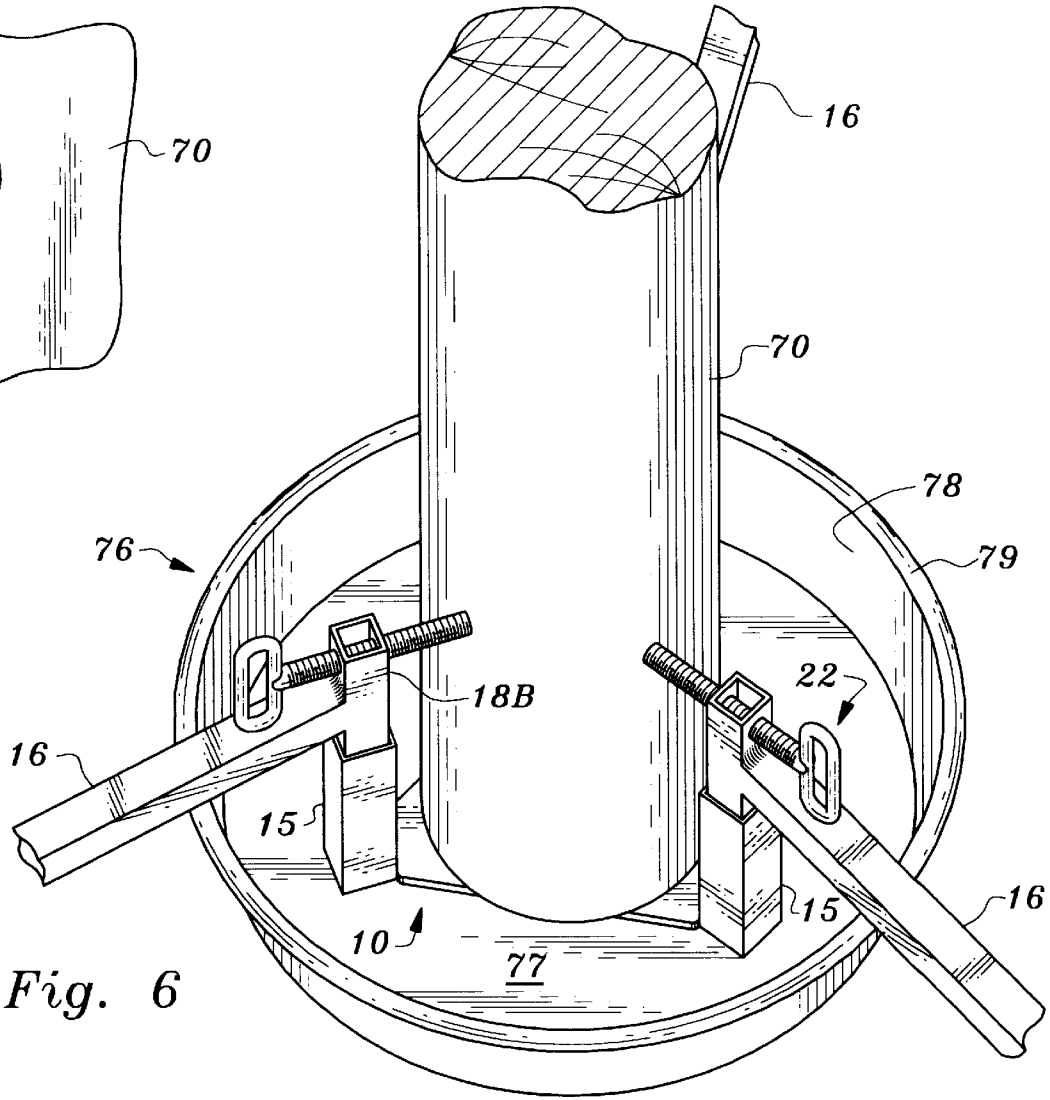
FIG. 6 is a top perspective view of this apparatus of this invention disposed within a vessel for water relation, but which vessel forms no part of this invention.

In FIG. 6, the inventive apparatus 10 is seen disposed in a common oil pan 76. Such pans have an upstanding side wall 78 with an outwardly extending lip 79. The side wall 78 is attached in a conventional manner to base 77. Such oil pans are used for the removal of oil from a car or for the short duration storage of fluids and may be made of metal or plastic.

Pans of this nature, which form no part of the invention herein, are readily available in the marketplace.

It is recommended that Christmas trees be kept in water during the period of time they are decorated in the home, to keep the trunk moist such that liquid passes by capillary action to the needles of the evergreen tree being showcased.

Since oil pans have a flat bottom, the apparatus of this invention can be set out flat such that the tree can be readily made to stand upright rather than tilted angularly away from the vertical, which is not desired.

USE OF APPARATUS

Apparatus 10 is first assembled by placing each part 18B of each leg portion 12 into an upstanding tube 15 of the main body, preferably while the main body is disposed within an oil pan such as 76 as seen in FIG. 6. It is readily seen therefore that if the upstanding tubes are round, the part 18B must be round, and if the upstanding tube 15 is square then the part 18B must be square, but in both instances slightly smaller for easy frictional engagement.

The tree trunk, —shown in broken line, since the tree forms no part of the invention—, is disposed upon the pin 19, and retained generally vertically by hand. The three thumb screws are partially tightened to apply uniform pressure to the trunk 70. Unfortunately in many instances, the tree will be tilted and not straight standing. By applying continuing pressure such that a particular screw's threaded area 24 is forced against the trunk 70, the first part 14 of the leg portion 12 in question, will become slightly elevated off the ground. The tree trunk 70 will stand erect and as pressure is applied, the first part of the particular leg portion will bend slightly downward relative to the respective second part 16 of that specific leg, as pressure is increased. Then when the tightness or taut point is reached, it will be found that post the bend of first part 14, that the three leg portions 12 will indeed be touching the ground. The amount of the bend will be slight, between ¼ and ½ inch.

The tightening of the thumb screw 22's handle creates a leverage effect, in that the leg part 14 moves downwardly (bends) as the trunk of the tree 70 moves upright. The actual amount of tree trunk penetration by the threaded portion 24 is slight, only about ½ inch, such that in large trees for which the apparatus is primarily intended, the tip of the threaded portion 24 rarely penetrates beyond the depth of the inner bark of the trunk and so no damage is done to the tree.

I have found that by employing the generally triangular shape of the main body, that it is much easier to achieve a good balance and leveling of the Christmas tree than if a square or rectangular base is employed. The unit of this invention can be assembled and disassembled in about 5 minutes or less and requires often one and generally no more than 2 people to erect a tall tree. Such is not the case using prior art rigging techniques which are much more timely and which require a more thorough safety inspection, not just from the tree support aspect, but from the point of view of not having spectators trip over unmarked wires.

Since certain changes may be made in the above-described apparatus without departing from the scope of the invention herein involved, it is intended that all matter contained in the above description and shown in the accompanying drawings shall be interpreted as illustrative and not in a limiting sense.

I claim:

1. A Christmas tree stand having a main body and a leg portion, wherein the main body comprises a base of a generally triangular configuration, said base having a trio of spaced upstanding tubes disposed there around and each having a first cross section, said leg portion comprising three identical legs each of which has three parts, a first part, a second part, and a third part;

the third part thereof being disposed at about a 70 degree angle to said second part at a second end thereof, said third part having a second cross section, slightly smaller than said first cross section whereby said third part being dispositionable within one of said upstanding tubes, each third part having adjustable tree engaging means thereon, whereby when each third part is disposed within one of said upstanding tube, the tree engaging means when tightened, will hold a Christmas tree therebetween in an upright disposition.

2. The Christmas tree stand of claim 1 wherein the main body also includes an upstanding pin, centrally disposed, wherein the pin will impale upon said tree when disposed thereon.

3. The Christmas tree stand of claim 1 wherein the tree engaging means on the third part of the leg portion is a thumb screw.

4. A Christmas tree stand for large Christmas trees, which comprises a main body and a leg portion, wherein the main body is a generally triangular base formed from a plate, the plate has three spaced upstanding tubes, around the periphery of said plate, each tube being of a first diameter cross section, wherein said leg portion comprises three identical legs each having three parts, a first short part angularly connected to the second part which is the longest thereof, and a third part of intermediate length connected to the second part at about a 70 degree angle, the end of the third part distant from the second part being dispositionable within said upstanding tubes on said main body, each said third part having tightenable tree engaging thumb screws for holding a tree upright.

5. The Christmas tree stand of claim 4 wherein the plate includes a centrally disposed upright pin.

6. The Christmas tree stand of claim 5 wherein each leg is formed of square tubing.

7. The Christmas tree stand of claim 4 wherein the main body also includes a centrally disposed upstanding pin, which pin will impale upon said tree when disposed thereon.

8. A Christmas tree stand having a main body and a leg portion, wherein the main body comprises a chamfered triangular plate, having an upstanding tube attached at each chamfered corner, and wherein the plate has a centrally disposed upstanding pin, the leg portion comprising three identical square tube legs each of which has three parts, a first part, a second part and a third part, the first part being the shortest and attached at about a 160 degree angle to the end of the second part and wherein the second part is the largest, the third part of each leg being disposed at the second end of the second part also at a 70 degree angle, but in the direction toward a first point and being disposable within one of said upstanding tube, the third part thereof also including a tree engaging thumb screw, the three of which when impinging upon a tree trunk will hold the tree in a vertical disposition.

9. The stand of claim 8 wherein each first and second parts of a leg are formed from a single bent square tube.

10. A Christmas tree stand having a main body and a leg portion dispositionable therein, said main body comprising a generally equi corner triangular flat plate, having a plurality of chamfered corners, each chamfered corner having an upstanding tube attached thereto at one end of said tube, each of said tubes being of a first cross section;

said leg portion comprising three identical legs, each of said legs has three parts, a first part, a second part, and a third part one part of said legs is engageable with one of the upstanding tubes of said main body;

the third part, first, second, third of each said leg being angularly disposed relative to and contiguously formed with the second part of said leg and each said third part having a second cross section, slightly smaller than the cross section of a respective one of said upstanding tube of the main body, whereby each said third part can be disposed within one of said upstanding tubes, each third part having an adjustable tree engaging thumb screw, with the threaded section directed inwardly, whereby when each third part is disposed within one of said upstanding tube, each tree engaging thumb screws when tightened, will hold a Christmas tree therebetween in an upright disposition.

11. The Christmas tree stand of claim 10 wherein both the upstanding tubes and the third part of each leg is formed of square tubing.

* * * * *